US012404590B2

(12) United States Patent
Chen et al.

(10) Patent No.: US 12,404,590 B2
(45) Date of Patent: Sep. 2, 2025

(54) HYBRID SEALING FOR ANODIZED METAL

(71) Applicant: RTX Corporation, Farmington, CT (US)

(72) Inventors: Lei Chen, South Windsor, CT (US); Weilong Zhang, Glastonbury, CT (US)

(73) Assignee: RTX CORPORATION, Farmington, CT (US)

( * ) Notice: Subject to any disclaimer, the term of this patent is extended or adjusted under 35 U.S.C. 154(b) by 144 days.

(21) Appl. No.: 17/097,736

(22) Filed: Nov. 13, 2020

(65) Prior Publication Data

US 2022/0154350 A1 May 19, 2022

(51) Int. Cl.
*C25D 11/24* (2006.01)
*C23F 11/04* (2006.01)
*C23F 11/18* (2006.01)

(52) U.S. Cl.
CPC ..... *C23F 11/185* (2013.01); *C23F 11/04* (2013.01); *C25D 11/246* (2013.01)

(58) Field of Classification Search
CPC ..... C23F 11/04; C23F 11/18; C23F 11/185; C23F 11/187; C25D 11/18; C25D 11/24; C25D 11/246
See application file for complete search history.

(56) References Cited

U.S. PATENT DOCUMENTS 3,077,425 A 2/1963 Fromson
3,414,489 A * 12/1968 Rogers ..... C25D 11/246 148/267
4,756,772 A * 7/1988 Gazapo ..... C25D 11/246 148/244
5,226,976 A * 7/1993 Carlson ..... C25D 11/246 148/265
5,954,893 A * 9/1999 Baldwin ..... C25D 11/24 148/272
6,537,678 B1 * 3/2003 Putnam ..... C23F 11/188 106/14.44

(Continued)

FOREIGN PATENT DOCUMENTS

CN 110857475 A * 3/2020 ..... C25D 11/246

OTHER PUBLICATIONS

Tian et al. ("Electrochemical behaviors of anodic alumina sealed by Ce—Mo in NaCl solutions," Trans. Nonferrous Met. Soc. China, 16, 2006, 1178-1183) (Year: 2006).*

(Continued)

*Primary Examiner* — Matthew R Diaz
(74) *Attorney, Agent, or Firm* — CANTOR COLBURN LLP

(57) ABSTRACT

Disclosed is a method of providing corrosion protection to an anodized metal including providing a metal having an anodization layer wherein the anodization layer includes a barrier portion; contacting the anodization layer with a first solution at a first temperature to seal the barrier portion; and contacting the anodization layer with the sealed barrier portion with a second solution at a second temperature to deposit a precipitated rare earth compound in the anodization layer with the sealed barrier portion; wherein the first solution includes a transition metal oxyanion and has a pH of 3 to 6 and the second solution includes a trivalent rare earth cation.

7 Claims, 2 Drawing Sheets

(56) References Cited

U.S. PATENT DOCUMENTS

| | | | | |
|---|---|---|---|---|
| 7,422,793 | B2 * | 9/2008 | Phelps | C25D 11/246 252/387 |
| 9,879,347 | B2 * | 1/2018 | Bares | C25D 11/246 |
| 10,023,963 | B2 * | 7/2018 | Ding | C23F 11/187 |
| 10,480,093 | B2 * | 11/2019 | van Hassel | C25D 11/246 |
| 10,760,164 | B2 | 9/2020 | Ding et al. | |
| 2018/0002825 | A1 * | 1/2018 | Balaraju | C25D 11/246 |
| 2018/0127883 | A1 * | 5/2018 | Ding | C25D 11/246 |
| 2018/0274121 | A1 | 9/2018 | Ding et al. | |
| 2018/0282879 | A1 * | 10/2018 | Opalka | C25D 11/246 |
| 2019/0376202 | A1 * | 12/2019 | He | C25D 11/246 |

OTHER PUBLICATIONS

"Rare Earth Elements" (The Geological Society of London, 2011) (Year: 2011).*

European Search Report for application EP 21206741, dated Mar. 31, 2022, 14 pages.

Yu, Xingwen et al., "Electrochemical study of the corrosion behavior of Ce sealing of anodized 2023 aluminum alloy", Thin Solid Films, 423 (2003), pp. 252-255.

* cited by examiner

HYBRID SEALING FOR ANODIZED METAL

BACKGROUND

Exemplary embodiments pertain to the art of corrosion protection for anodized metals.

Anodized metals such as high strength aluminum alloys are used in a variety of applications and can be subjected to harsh conditions. In some instances, the anodized metals can experience corrosion as a result of exposure to heavy air pollution. The corrosion can include both inter-granular attack and localized corrosion such as pitting. While currently available sealing processes can reduce the amount of corrosion, better protection is desired, particularly for environments that contain acidic compounds.

BRIEF DESCRIPTION

Disclosed is a method of providing corrosion protection to an anodized metal including providing a metal having an anodization layer wherein the anodization layer includes a barrier portion; contacting the anodization layer with a first solution at a first temperature to seal the barrier portion; and contacting the anodization layer with the sealed barrier portion with a second solution at a second temperature to deposit a precipitated rare earth compound in the anodization layer with the sealed barrier portion; wherein the first solution includes a transition metal oxyanion and has a pH of 3 to 6 and the second solution includes a trivalent rare earth cation.

In addition to one or more of the features described above, or as an alternative to any of the foregoing embodiments, the transition metal oxyanion includes one or more of permanganate ($MnO_4^-$), tungstate ($WO_4^{2-}$), molybdate ($MoO_4^{2-}$), vanadate ($VO_4^{3-}$), dichromate ($Cr_2O_7^{2-}$) and chromate ($CrO_4^-$).

In addition to one or more of the features described above, or as an alternative to any of the foregoing embodiments, the transition metal oxyanion is present in the first solution in an amount of 0.1 to 30 millimoles (mM).

In addition to one or more of the features described above, or as an alternative to any of the foregoing embodiments, the first temperature is 60 to 100° C.

In addition to one or more of the features described above, or as an alternative to any of the foregoing embodiments, the anodization layer is contacted with the first solution for 15 to 30 minutes.

In addition to one or more of the features described above, or as an alternative to any of the foregoing embodiments, the method may further include rinsing the anodization layer with the sealed barrier portion before contacting it with the second solution.

In addition to one or more of the features described above, or as an alternative to any of the foregoing embodiments, the trivalent rare earth cation includes one or more of the following cations: $La^{3+}$, $Ce^{3+}$, $Pr^{3+}$, $Nd^{3+}$, $Sm^{3+}$, $Eu^{3+}$, $Gd^{3+}$,$Tb^{3+}$, $Dy^{3+}$, $Ho^{3+}$, $Er^{+}$, $Tm^{3+}$, $Yb^{3+}$, $Lu^{3+}$, $Y^{3+}$, and $Sc^{3+}$.

In addition to one or more of the features described above, or as an alternative to any of the foregoing embodiments, 10 to 100 mM of an oxidant is included in the second solution. The pH of the second solution may be 3.5 to 6.5.

In addition to one or more of the features described above, or as an alternative to any of the foregoing embodiments, the anodized metal is aluminum or an aluminum alloy.

In addition to one or more of the features described above, or as an alternative to any of the foregoing embodiments, the second temperature is 10° C. to 70° C.

Also disclosed is an anodized metal including an anodization layer having a sealed barrier portion and a precipitated rare earth compound disposed in the anodization layer.

In addition to one or more of the features described above, or as an alternative to any of the foregoing embodiments, the anodized metal includes aluminum or an aluminum alloy.

In addition to one or more of the features described above, or as an alternative to any of the foregoing embodiments, the precipitated rare earth compound includes a metal hydroxide wherein the metal is La, Ce, Pr, Nd, Sm, Eu, Gd, Tb, Dy, Ho, Er, Tm, Yb, Lu, Y, or Sc.

DETAILED DESCRIPTION

Figure 1:
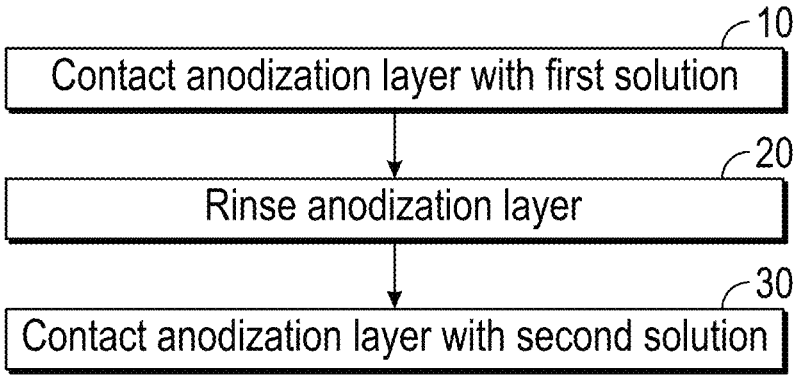
FIG. 1 is a flow chart of the method described herein.

A detailed description of one or more embodiments of the disclosed apparatus and method are presented herein and in the Figures by way of exemplification and not limitation.

Anodizing is an electrolytic passivation process where a metal article operates as an anode in an electrical circuit and an anodization layer is grown on the surface of the article as a result of converting a metallic element (that is part of the metal article) to oxides and related compounds. The anodizing process is commonly used to create an anodization layer on aluminum alloys. The as-made anodization layer is porous, thus incapable of protecting the underlaying metal from corrosion.

Defects in the barrier portion of the anodization layer, an insufficient amount of corrosion inhibitors in the anodization layer or a combination of these issues can lead to premature corrosion of the metal surface. The failure can occur more rapidly and become more severe in the regions where air pollution produces a more aggressive chemical environment, leading to localized corrosion such as pitting and inter-granular attacks. Localized corrosion is detrimental for structural materials as cracks can initiate from the corrosion sites at a stress load lower than what the material is designed for. To improve material durability in environments challenging for anodized components, each of the two performance attributes of an anodization layer, density and inhibitor concentration, need to be optimized without debiting one another.

The anodization layer includes a barrier portion. The barrier portion has low porosity but also has defects. As described herein the anodization layer is contacted with a first solution at a first temperature. Exemplary anodized metals include aluminum and aluminum alloys. Contact with the first solution results in sealing the barrier portion of the anodization layer. Without being bound by theory it is believed that oxide from the anodization layer reacts with the first solution to form a metal oxy hydroxide. Additionally the oxide swells and closes defects to seal the barrier portion of the anodization layer.

The first solution may include one or more transition metal oxyanions. Exemplary transition metal oxyanions include permanganate ($MnO^{4-}$), tungstate ($WO_4^{2-}$), molybdate ($MoO_4^{2-}$), vanadate ($VO_4^{3-}$), chromate ($Cr_4^{-}$), and dichromate ($Cr_2O_7^{2-}$). The first solution may have a transition metal oxyanion concentration greater than or equal to 0.1 millimolar (mM) (1 mM=0.001 mol/L) and less than or equal to 30 mM. Within this range the concentration may be greater than or equal to 0.5 mM or greater than or equal to 1 mM. Also within this range the concentration may be less than or equal to 20 mM ppm or less than or equal to 10 mM.

The pH of the first solution is greater than or equal to 3 and less than or equal to 6. Within this range the pH may be greater than or equal to 3.1, or greater than or equal to 3.3. Also within this range the pH may be less than or equal to 5.8, or less than or equal to 5.6. The contact time with the first solution may be greater than or equal to 15 minutes and less than or equal to 30 minutes.

The anodization layer is contacted with the first solution at a temperature greater than or equal to 60° C. and less than or equal to 100° C. Within this range the temperature may be greater than or equal to 75° C., or, greater than or equal to 90° C. Also within this range the temperature may be less than or equal to 98° C., or less than or equal to 96° C.

After the barrier portion is sealed the anodization layer may be rinsed and then contacted with a second solution. Rinsing may occur at a temperature of 10° C. to 35° C. for 0.5 to 5 minutes. The second solution includes a trivalent rare earth cation. Exemplary trivalent rare earth cations include $La^{3+}$, $Ce^{3+}$, $Pr^{3+}$, $Sm^{3+}$, $Eu^{3+}$, $Gd^{3+}$, $Tb^{3+}$, $Dy^{3+}$, $Ho^{3+}$, $Er^{3+}$, $Tm^{3+}$, $Yb^{3+}$, $Lu^{3+}$, $Y^{3+}$, and $Sc^{3+}$. The rare earth cation may combine with an anion such as hydroxide, subsequently precipitating as a rare earth compound in the anodization layer. Without being bound by theory it is believed that the precipitate itself may provide corrosion protection after being liberated in an acidic environment. The rare earth cation may be mobilized on demand and imparts corrosion protection to the metal in an aggressive acidic environment while mitigating corrosion causing anions such as chloride and sulfate.

The second solution has a rare earth cation concentration greater than or equal to 1 mM and less than or equal to 50 mM. Within this range the concentration may be greater than or equal to 2 mM or greater than or equal to 3 mM. Also within this range the concentration may be less than or equal to 40 mM or less than or equal to 10 mM. The second solution may also include 10 mM to 100 mM of an oxidant such as hydrogen peroxide ($H_2O_2$) to facilitate precipitation of the rare earth compound.

The anodization layer is contacted with the second solution at a temperature greater than or equal to 10° C. and less than or equal to 70° C. Within this range the temperature may be greater than or equal to 25° C., or greater than or equal to 30° C. Also within this range the temperature may be less than or equal to 60° C. or less than or equal to 50° C.

The pH of the second solution may be greater than or equal to 3.5 and less than or equal to 6.5. Within this range the pH may be greater than or equal to 4.5. Also within this range the pH may be less than or equal to 6.

The contact time with the second solution is greater than or equal to 15 minutes and less than or equal to 30 minutes. The contact time with the first solution may be less than the contact time with the second solution.

Turning now to the Figures, FIG. 1 is a flow chart showing the method described herein including contacting the anodization layer with the first solution at a first temperature 10, followed by rinsing 20 in water at a temperature of 10-30° C. for 30 seconds to 15 minutes, followed by contacting the anodization layer with a second solution at a second temperature 30.

Figure 2:
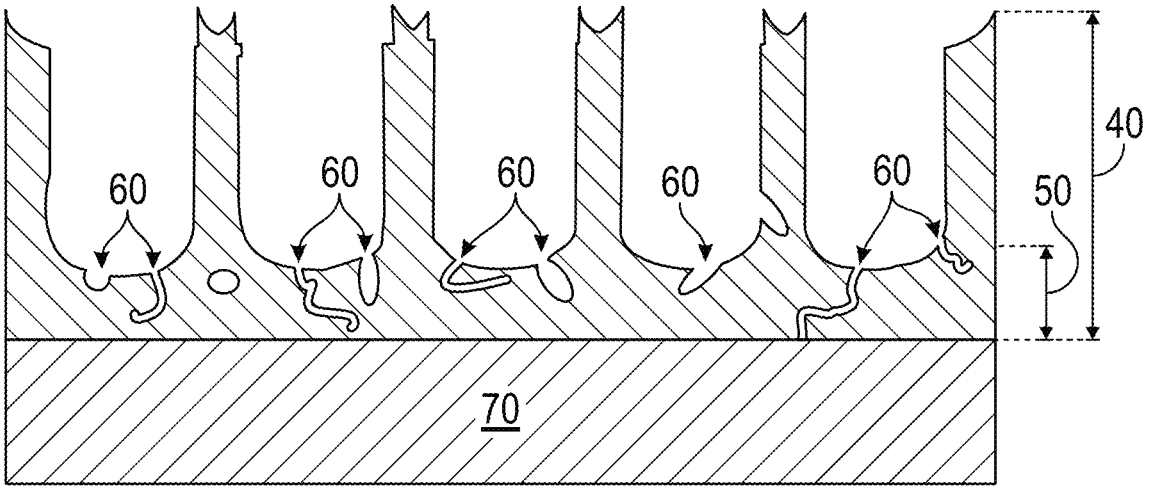
FIG. 2 illustrates an anodized metal having an anodization layer with a sealed barrier portion.

FIG. 2 shows the as deposited anodization layer 40 having a barrier portion 50 with defects 60. The anodization layer is disposed on the metal 70. The metal 70 and the anodization layer 40 together form the anodized metal 80.

Figure 3:
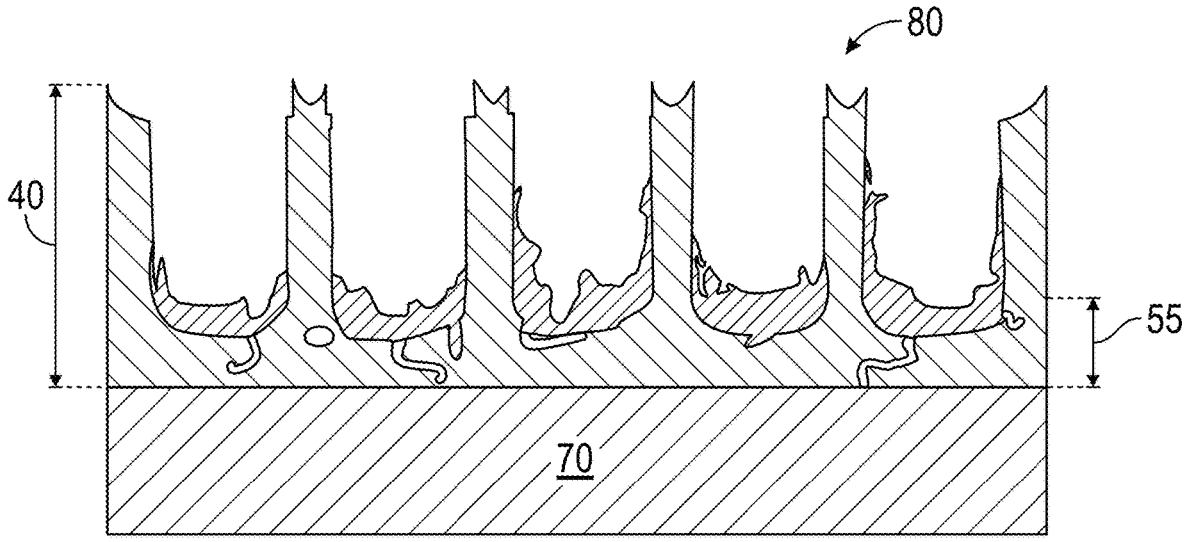
FIG. 3 illustrates an anodized metal having an anodization layer with a sealed barrier portion.

FIG. 3 shows the anodized metal 80 after the anodization layer 40 has been contacted with the first solution as described above. Contact with the first solution has formed a sealed barrier portion 55.

Figure 4:
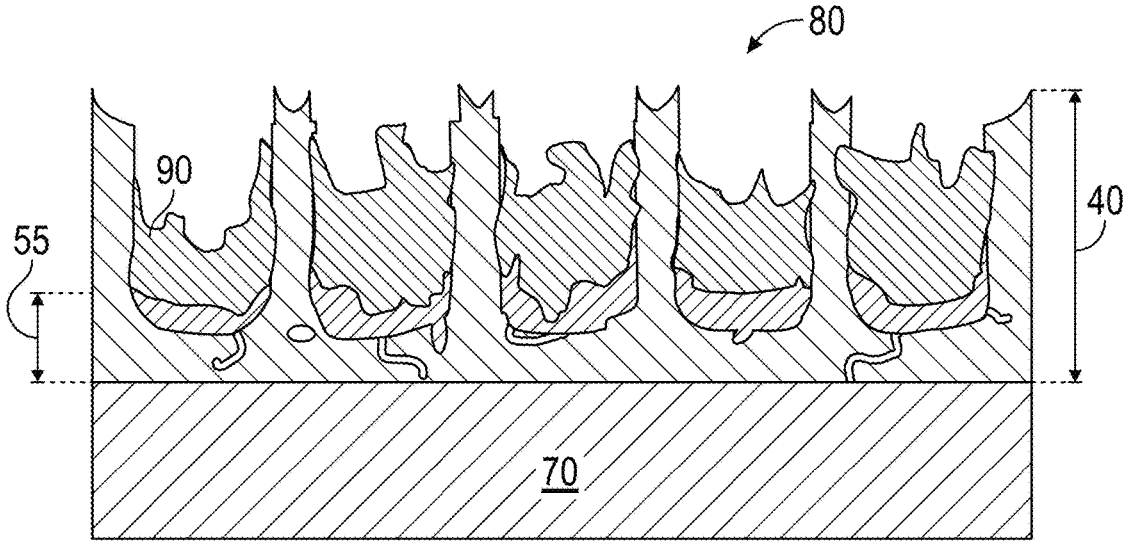
FIG. 4 illustrates an anodized metal having an anodization layer with a sealed barrier portion and a precipitated rare earth compound disposed in the anodization layer.

FIG. 4 shows the anodized metal 80 having an anodization layer 40 with sealed barrier portion 55 after contact with the second solution as described above. As shown in FIG. 4 precipitated rare earth compound 90 is disposed in anodization layer 40.

A sample of an anodized aluminum alloy was subjected to an aggressive acidic environment for 48 hours. The sample showed significant evidence of inter-granular attack. A sample of an anodized aluminum alloy was contacted with a first solution (single step protection) and subsequently subjected to an aggressive acidic environment for 48 hours. The sample showed less inter-granular attack than the untreated sample, but inter-granular attack was not eliminated. Another sample of the same aluminum alloy was treated with a first solution to form a barrier layer and then treated with a second solution as described above. This sample was subjected to the same aggressive acidic environment as the untreated anodized alloy and showed no evidence of inter-granular attack.

The above described method results in an anodized metal article comprising a metal substrate having a surface, a barrier layer disposed on the metal substrate surface, and an anodization layer disposed on the barrier layer, wherein the anodization layer comprises a precipitated rare earth compound. The anodized metal article is useful in a range of applications including stator vanes, fan cases and shrouds for gas turbine engines.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of providing corrosion protection to an anodized metal comprising:

providing a metal having an anodization layer wherein the anodization layer includes a barrier portion;

contacting the anodization layer with a first solution at a first temperature to seal the barrier portion; and contacting the anodization layer with the sealed barrier portion with a second solution at a second temperature to deposit a precipitated rare earth compound in the anodization layer with the sealed barrier portion;

wherein the first solution includes a transition metal oxyanion and has a pH of 3 to 6 wherein the transition metal oxyanion comprises one or more of tungstate, molybdate, vanadate, chromate, and dichromate and the second solution includes a trivalent rare earth cation;

further comprising rinsing the anodization layer with the sealed barrier portion before contacting it with the second solution, and wherein the rinsing occurs at a temperature of 10 to 35° C. for 0.5 to 5 minutes;

wherein the second solution has a rare earth cation concentration greater than or equal to 1 mM and less than or equal to 50 mM and wherein the second solution further comprises 10 to 100 mM of an oxidant, and wherein the trivalent rare earth cation includes one or more of the following cations: $Pr^{3+}$, $Nd^{3+}$, $Sm^{3+}$, $Eu^{3+}$, $Gd^{3+}$, $Tb^{3+}$, $Dy^{3+}$, $Ho^{3+}$, $Er^{3+}$, $Tm^{3+}$, $Yb^{3+}$, $Lu^{3+}$, $Y^{3+}$, and $Sc^{3\pm}$.

2. The method of claim 1, wherein the transition metal oxyanion is present in the first solution in an amount of 0.1 mM to 30 mM.

3. The method of claim 1, wherein the first temperature is 60 to 100° C.

4. The method of claim 1, wherein the anodization layer is contacted with the first solution for 15 to 30 minutes.

5. The method of claim 1, wherein the second solution has a pH of 3.5 to 6.5.

6. The method of claim 1, wherein the second temperature is 10° C. to 70° C.

7. The method of claim 1, wherein the anodized metal is aluminum or an aluminum alloy.

* * * * *